US009987538B1

(12) United States Patent
Crosby et al.

(10) Patent No.: US 9,987,538 B1
(45) Date of Patent: Jun. 5, 2018

(54) BOTTLE TOSSING GAME AND METHOD

(71) Applicants: Brent Crosby, Camarillo, CA (US); Chase M. Crosby, Camarillo, CA (US)

(72) Inventors: Brent Crosby, Camarillo, CA (US); Chase M. Crosby, Camarillo, CA (US)

( * ) Notice: Subject to any disclaimer, the term of this patent is extended or adjusted under 35 U.S.C. 154(b) by 0 days. days.

(21) Appl. No.: 15/434,694

(22) Filed: Feb. 16, 2017

(51) Int. Cl.
*A63B 67/06* (2006.01)
*A63B 71/06* (2006.01)
*A63B 63/00* (2006.01)

(52) U.S. Cl.
CPC ..... *A63B 67/06* (2013.01); *A63B 71/06* (2013.01); *A63B 63/00* (2013.01); *A63B 2210/50* (2013.01); *A63B 2220/51* (2013.01)

(58) Field of Classification Search
CPC ..... A63B 63/00; A63B 67/06
USPC ..... 273/398–402
See application file for complete search history.

(56) References Cited

U.S. PATENT DOCUMENTS 1,542,063 A * 6/1925 Knight ..... A63F 9/0204 124/7
4,930,777 A * 6/1990 Holenstein ..... A63B 43/002 273/DIG. 20
D326,377 S 5/1992 Nagel
5,435,570 A * 7/1995 Labrasseur ..... A63F 9/02 273/355
8,776,727 B1 7/2014 Nelligan
9,364,733 B2 6/2016 Esposito
2007/0063447 A1 3/2007 Gholson et al.
2009/0301991 A1* 12/2009 Yarro ..... B65D 1/0276 215/382
2010/0032901 A1 2/2010 Creech et al.
2010/0120559 A1* 5/2010 Biederman ..... A63B 63/00 473/470
2011/0095484 A1* 4/2011 Scott ..... A63B 67/06 273/336
2013/0109513 A1* 5/2013 Fernandez ..... A63B 67/06 473/585
2015/0115532 A1* 4/2015 Martinson ..... A63B 67/06 273/400

* cited by examiner

*Primary Examiner* — Mark Graham
(74) *Attorney, Agent, or Firm* — Eric Karich; Karich & Associates

(57) ABSTRACT

A tossing game includes an apparatus that includes a vertical support body and a support base attached to a bottom end of the vertical support body for supporting the vertical support body in an vertical orientation. The vertical support body includes a plurality of target platforms that include a target surface that is sized and shaped for supporting the bottle once it has been successfully tossed onto one of the target platforms. The invention further includes a method of playing a game utilizing the tossing game apparatus.

1 Claim, 4 Drawing Sheets

BOTTLE TOSSING GAME AND METHOD

BACKGROUND OF THE INVENTION

Field of the Invention

This invention relates generally to a tossing games, and more particularly to a bottle tossing game and a method for playing the bottle tossing game.

Description of Related Art

The prior art teaches a wide range of tossing games that are well known in the art. Examples of such games include horse shoes, yard darts, bean bag tossing games, and many other similar games. Such games are popular to play in outdoor parties and get togethers, often in parks, beaches, and similar venues.

Gholson, U.S. 2007/0063447, teaches a toss game that includes a plurality of platforms disposed on a target platform, and the steps of tossing items such as beanbags onto the platforms or into target receptacles. A similar tossing game is also shown in Esposito, U.S. Pat. No. 9,364,733.

A new form of game that is becoming popular is bottle tossing, wherein a bottle partially filled with water is tossed into the air such that it lands upright on a table or other surface.

The skill lies in making it land and "stick" in an upright position. This is not file typically part of a larger game, it is simply an amusing pastime to see if you can properly land the bottle.

The prior art teaches various forms of games of skill, such as tossing various objects onto or into targets, and the prior art also teaches bottle tossing. However, the prior art does not teach a bottle tossing game that requires a person to successfully toss a bottle, partially filled with water, such that it lands and remains on one of a plurality of target platforms. The game includes a method of playing, landing multiple bottles on multiple target platforms, as well as sensors, lights, and other improvements that make the game more challenging and entertaining. The present invention fulfills these needs and provides further advantages as described in the following summary.

SUMMARY OF THE INVENTION

The present invention teaches certain benefits in construction and use which give rise to the objectives described below.

The present invention provides a tossing game that includes an apparatus that includes a vertical support body and a support base attached to a bottom end of the vertical support body for supporting the vertical support body in an vertical orientation. The vertical support body includes a plurality of target platforms that include a target surface that is sized and shaped for supporting the bottle once it has been successfully tossed onto one of the target platforms. The invention further includes a method of playing a game utilizing the tossing game apparatus.

A primary objective of the present invention is to provide a tossing game having advantages not taught by the prior art.

Another objective is to provide a tossing game that is fun and easy to play.

A further objective is to provide a tossing game that can be played with ordinary water bottles, and does not require unique tossing elements.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a tossing game that may be played with ordinary water bottles. A user may attempt to toss or "flip" a bottle onto a tossing game apparatus, as described in greater detail below.

Figure 1:
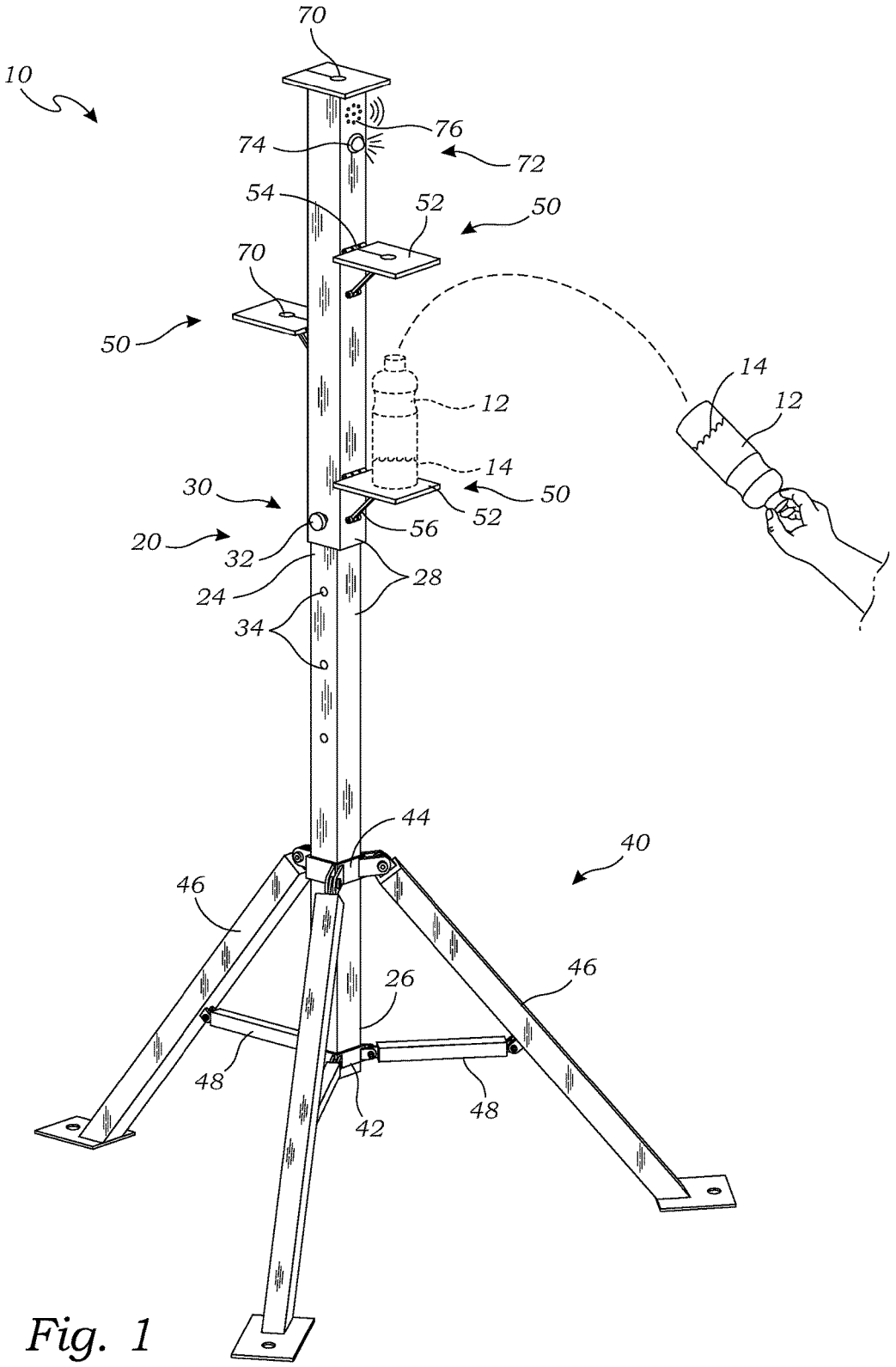
FIG. 1 is a perspective view of a tossing game apparatus according to one embodiment of the present invention, illustrating a person tossing a bottle onto one of a plurality of target platforms.

FIG. 1 is a perspective view of one embodiment of the tossing game apparatus 10, illustrating a person tossing a bottle 12 onto one of a plurality of target platforms 50.

Figure 2:
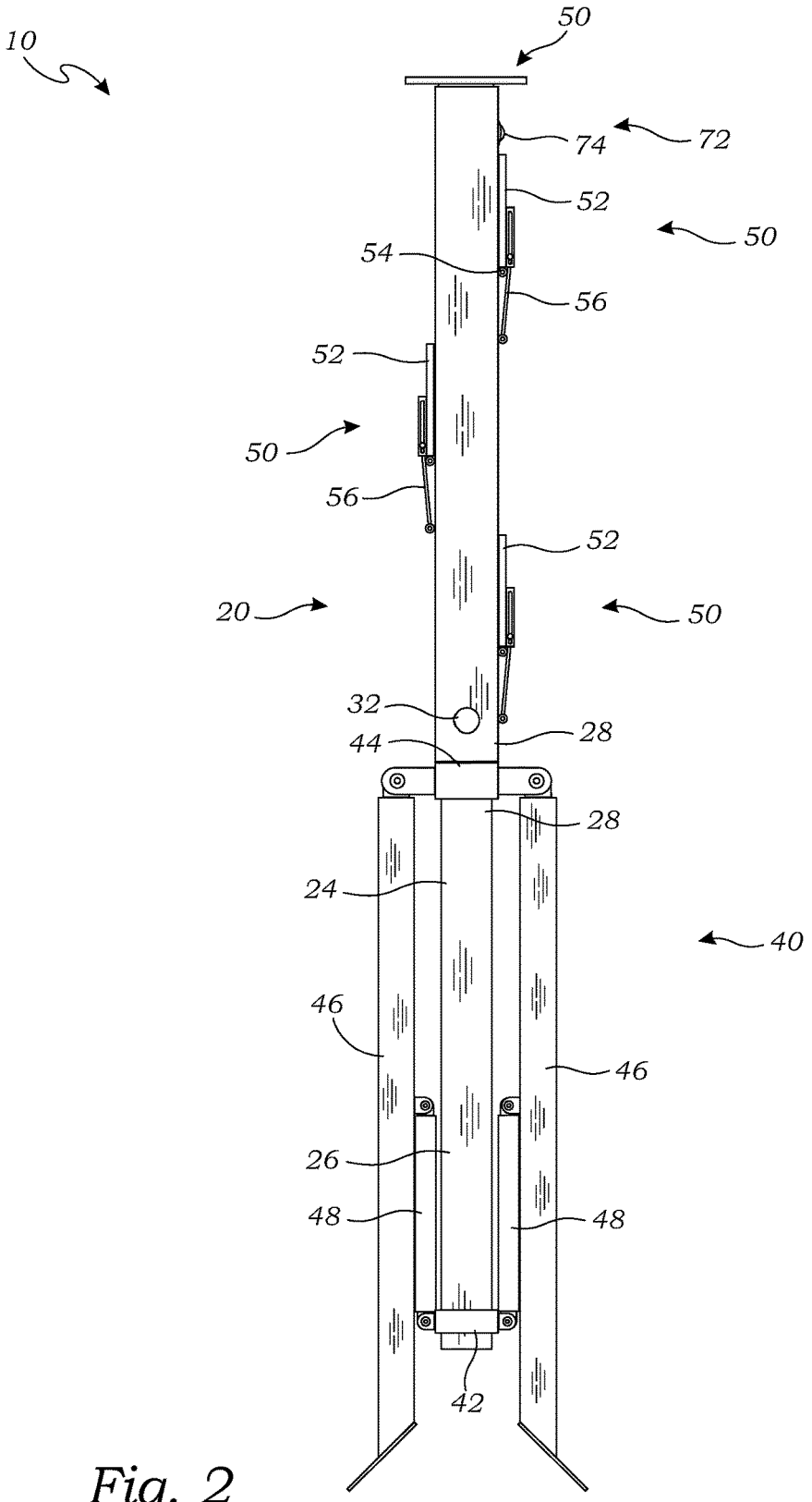
FIG. 2 is a front elevational view of the tossing game apparatus of FIG. 1, illustrating the tossing game apparatus once it has been collapsed for shipping or storage.

FIG. 2 is a front elevational view of the tossing game apparatus 10 of FIG. 1, illustrating the tossing game apparatus 10 once it has been collapsed for easy shipping or storage.

As shown in FIGS. 1 and 2, the tossing game apparatus 10 includes a vertical support body 20, a support base 40, and a plurality of target platforms 50 onto which a user may attempt to toss the bottle 12. The vertical support body 20 may have an elongate construction, and may include a top end 22, a middle portion 24, and a bottom end 26. In the present embodiment, the vertical support body 20 comprises a plurality of elongate tubes 28 that telescopically engage each other so that the plurality of elongate tubes 28 may move between an extended position and a collapsed position.

In this embodiment, the vertical support body 20 may further include a locking mechanism 30 for locking the plurality of elongate tubes 28 in the extended position (and optionally in the collapsed position as well). In the present embodiment, the locking mechanism 30 includes a spring post 32 operably mounted on one of the elongate tubes 28, and at least one aperture 34 in the adjoining elongate tube 28, so that the relative positions of the elongate tubes 28 may be locked in place. While multiple apertures 34 are illustrated, a single aperture 34 may alternatively be used. Furthermore, while a single pair of tubes 28 are illustrated, and have a square cross sectional shape, additional tubes, and/or alternative shapes and configuration may also be used.

While the current elongate shape of the vertical support body 20 is illustrated, alternative structures which may provide the plurality of target platforms 50 may also be used, and the particular shape and configuration may be adapted by one skilled in the art so that the game is attractive to consumers.

As shown in FIGS. 1 and 2, the support base 40 may be attached to the bottom end of the vertical support body 20 for supporting the vertical support body 20 in an vertical orientation. For purposes of this application, the term "attached" is defined to include any form of attachment, mounting, including having the support base 40 integrally formed with the vertical support body 20.

In this embodiment, the support base 40 may comprise a fixed mounting mechanism 42 fixedly attached to the vertical support body 20, a sliding mounting mechanism 44 slidably mounted on the vertical support body 20, and a plurality of support legs 46, each attached to the fixed mounting mechanism 42 and the sliding mounting mechanism 44, either directly or through a strut 48, such that sliding the sliding mounting mechanism causes the plurality of support legs to move between an open configuration and a folded configuration. While one embodiment of a support base 40 is illustrated, those skilled in the art may devise a wide range of alternative structures that will suitably support the vertical support body 20, and such alternatives should be considered within the scope of the present invention.

The plurality of target platforms 50 may be mounted on the vertical support base 40 such that a target surface 52 is supported in a generally horizontal orientation. The target surface 52 is sized and shaped for supporting the bottle 12 once it has been successfully tossed onto one of the target platforms 50. In operation, as shown in FIG. 1, the bottle 12 is partially filled with water 14, and then tossed in a flipping motion, with the goal of getting the bottle 12 to land and "stick" on one of the target platforms 50. For purposes of this application, the term "filling" is defined to also include the option of partially emptying a previously filled bottle.

In this embodiment, the plurality of target platforms 50 are each attached to the vertical support body 20 via a pivot 54 so that each of the target platforms 50 may pivot between an extended position for use, and a folded position for shipping and storage. In this embodiment, the plurality of target platforms 50 are each further attached to the vertical support body 20 with a support strut 56 for supporting the target platform in the extended position, to better support the weight of the bottle 12. In alternative embodiments, however, the target platforms 50 may be mounted in alternative ways, or integrally formed with the vertical support body 20.

Figure 3:
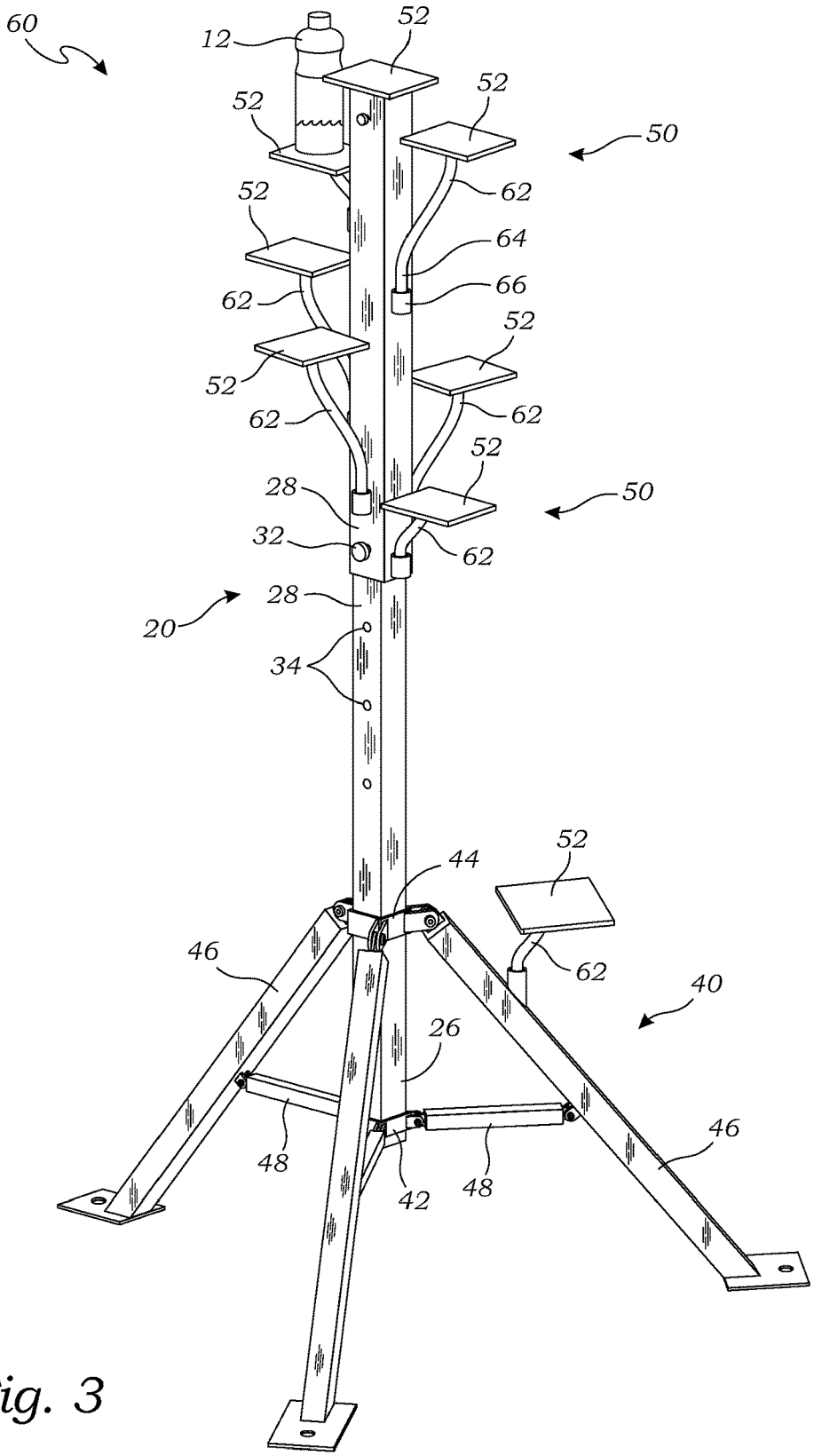
FIG. 3 is a perspective view of a second embodiment of the tossing game apparatus.

FIG. 3 is a perspective view of a second embodiment of the tossing game apparatus 60. In this second embodiment of the tossing game apparatus 60, the plurality of target platforms 50 each include a target surface 52 that is operably mounted on a support arm 62 that extends to an end 64, and the vertical support body 20 includes a receiver 66 that receives the end 64 (e.g., frictionally, threadedly, etc.). Obviously, those skilled in the art may devise a range of other alternatives, which should be considered within the scope of the present invention.

Figure 4:
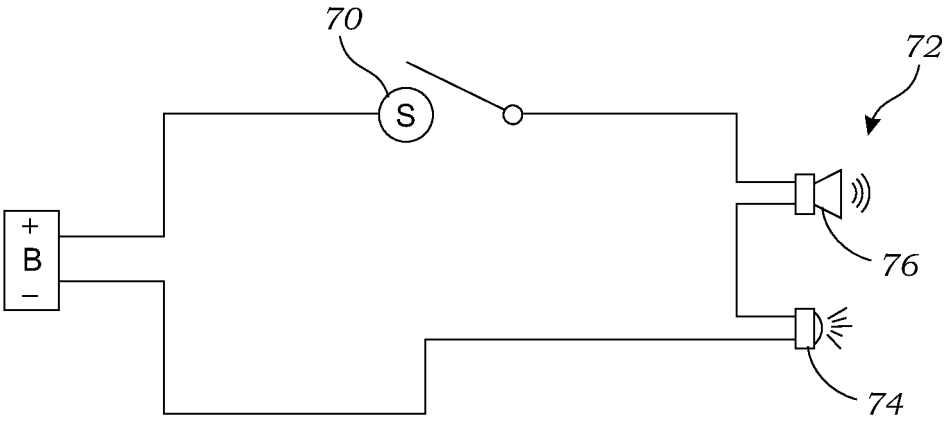
FIG. 4 is a schematic of electronics that may be included in one embodiment of the tossing game apparatus.

FIG. 4 is a schematic of electronics that may be included in one embodiment of the tossing game apparatus 10. As shown in FIGS. 1 and 4, at least one of the plurality of target platforms 50 may further include a sensor 70 for detecting whether the bottle 12 has landed successfully on the target platform 50, and an indicator 72 for indicating that success was achieved. In this embodiment, the sensor 70 is a force sensor, although alternative forms of sensors known in the art may also be used.

As shown in FIGS. 1 and 4, in this embodiment the indicator 72 includes a light emitting diode 74 (or equivalent visual indicator), and further includes a speaker 76 (or equivalent form of buzzer or noise maker).

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A method for playing a game with a bottle, the method comprising the steps of:

providing a tossing game apparatus comprising:

a vertical support body having a top end, a middle portion, and a bottom end;

a support base attached to the bottom end of the vertical support body for supporting the vertical support body in an vertical orientation; and a plurality of target platforms mounted on the vertical support base such that a target surface is supported in a generally horizontal orientation, the target surface being sized and shaped for supporting the bottle once it has been successfully tossed onto one of the target platforms;

partially filling the bottle with water;

tossing the bottle into the air in an attempt to cause the bottle to land on one of the target platforms.

* * * * *